US009886854B2

(12) United States Patent
Jones

(10) Patent No.: US 9,886,854 B2
(45) **Date of Patent: *Feb. 6, 2018**

(54) TRAFFIC BEACON

(71) Applicant: Richard D. Jones, Venice, FL (US)

(72) Inventor: Richard D. Jones, Venice, FL (US)

(73) Assignee: R.D. Jones, Stop Experts, Inc., Venice, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/211,617

(22) Filed: Jul. 15, 2016

(65) Prior Publication Data

US 2016/0358465 A1 Dec. 8, 2016

Related U.S. Application Data

(63) Continuation of application No. 14/480,912, filed on Sep. 9, 2014, now Pat. No. 9,659,493, which is a (Continued)

(51) Int. Cl.
*G08G 1/095* (2006.01)
*G08G 1/0955* (2006.01)
(Continued)

(52) U.S. Cl.
CPC ..... *G08G 1/0955* (2013.01); *E01F 9/00* (2013.01); *E01F 9/617* (2016.02); *E01F 9/658* (2016.02); *G08G 1/095* (2013.01)

(58) Field of Classification Search
None
See application file for complete search history.

(56) References Cited

U.S. PATENT DOCUMENTS 1,951,431 A 3/1934 Meehan
2,121,093 A 6/1938 Munch
(Continued)

FOREIGN PATENT DOCUMENTS

JP 11213730 8/1999
JP 2001-338777 12/2001
(Continued)

OTHER PUBLICATIONS

"Emergency Vehicle Warning Lights: State of the Art" by Gerald L. Howett, U.S. Department of Commerce, Oct. 30, 1978, pp. 1-181.
(Continued)

*Primary Examiner* — George Bugg
*Assistant Examiner* — Renee Dorsey
(74) *Attorney, Agent, or Firm* — Jerold I. Schneider; Schneider Rothman Intellectual Property Law Group, PLLC

(57) ABSTRACT

A flashing beacon may include a signal unit, a control unit associated with the signal unit, a solar panel or collector, and an activation device that may all be mounted or otherwise positioned on a post of a roadway sign. Light units associated with the signal unit may be programmed to flash on and off in a unique wig-wag pattern. Further, a light bar may also be used with the beacon to generate an intense flash of light soon after activation of the beacon as an additional means of grabbing the attention of the operator of a vehicle.

24 Claims, 8 Drawing Sheets

Related U.S. Application Data continuation-in-part of application No. 13/584,038, filed on Aug. 13, 2012, now Pat. No. 9,129,540, which is a continuation of application No. 13/230,242, filed on Sep. 12, 2011, now Pat. No. 8,269,654, which is a continuation of application No. 12/303,802, filed as application No. PCT/US2007/070494 on Jun. 6, 2007, now Pat. No. 8,081,087.

(60) Provisional application No. 60/811,157, filed on Jun. 6, 2006, provisional application No. 61/879,431, filed on Sep. 18, 2013, provisional application No. 61/875,221, filed on Sep. 9, 2013.

(51) Int. Cl.

| | |
|---|---|
| ***E01F 9/00*** | (2016.01) |
| ***E01F 9/615*** | (2016.01) |
| ***E01F 9/658*** | (2016.01) |

(56) References Cited

U.S. PATENT DOCUMENTS

| | | | | |
|---|---|---|---|---|
| 2,679,635 | A | 5/1954 | Hart | |
| 2,902,672 | A | 9/1959 | Hart | |
| 2,965,880 | A | 12/1960 | Hart | |
| 2,967,293 | A | 1/1961 | Paulson | |
| 3,205,478 | A | 9/1965 | Schleg | |
| 3,757,291 | A * | 9/1973 | Lilly | G08G 1/095 340/908 |
| 3,963,202 | A | 6/1976 | Hopkins | |
| 4,254,453 | A | 3/1981 | Mouyard et al. | |
| 4,860,177 | A | 8/1989 | Simms | |
| 4,879,545 | A | 11/1989 | Aguilar | |
| 5,023,607 | A | 6/1991 | Staten | |
| 5,103,223 | A | 4/1992 | Humphrey | |
| 5,235,768 | A | 8/1993 | Eder | |
| 5,276,422 | A | 1/1994 | Ikeda et al. | |
| 5,313,188 | A * | 5/1994 | Choi | G08B 5/38 315/200 A |
| 5,580,156 | A | 12/1996 | Suzuki et al. | |
| 5,735,492 | A | 4/1998 | Pace | |
| 6,035,567 | A | 3/2000 | Cameron | |
| 6,107,941 | A | 8/2000 | Jones | |
| 6,147,623 | A | 11/2000 | Rippen | |
| 6,193,392 | B1 | 2/2001 | Lodhie | |
| 6,250,774 | B1 | 6/2001 | Begemann et al. | |
| 6,384,742 | B1 | 5/2002 | Harrison | |
| 6,504,179 | B1 | 1/2003 | Ellens et al. | |
| 6,515,584 | B2 | 2/2003 | DeYoung | |
| 6,522,263 | B2 | 2/2003 | Jones | |
| 6,614,103 | B1 | 9/2003 | Durocher et al. | |
| 6,693,556 | B1 | 2/2004 | Jones et al. | |
| 6,879,263 | B2 | 4/2005 | Pederson et al. | |
| 6,942,361 | B1 | 9/2005 | Kishimura et al. | |
| 6,963,275 | B2 | 11/2005 | Smalls | |
| 7,019,669 | B1 | 3/2006 | Carr | |
| 7,196,636 | B2 | 3/2007 | Graham | |
| 7,298,245 | B1 | 11/2007 | VanHoose | |
| 7,317,405 | B2 | 1/2008 | Green et al. | |
| 7,688,222 | B2 | 3/2010 | Peddie et al. | |
| 8,081,087 | B2 | 12/2011 | Jones | |
| 8,269,654 | B2 | 9/2012 | Jones | |
| 9,129,540 | B2 | 9/2015 | Jones | |
| 2001/0054970 | A1 | 12/2001 | Jones | |
| 2002/0073586 | A1 | 6/2002 | Backe | |
| 2002/0105432 | A1 | 8/2002 | Pederson et al. | |
| 2003/0067399 | A1 | 4/2003 | Wesley | |
| 2003/0222791 | A1 | 12/2003 | Smalls | |
| 2004/0183694 | A1 | 9/2004 | Bauer | |
| 2005/0012636 | A1 * | 1/2005 | Gallagher | H05B 33/0803 340/815.45 |
| 2005/0104747 | A1 | 5/2005 | Silic et al. | |
| 2005/0128105 | A1 | 6/2005 | Green et al. | |
| 2005/0174776 | A1 | 8/2005 | Althaus | |
| 2005/0184883 | A1 | 8/2005 | Graham | |
| 2006/0012487 | A1 | 1/2006 | Gibson et al. | |
| 2006/0061487 | A1 | 3/2006 | Heap | |
| 2006/0232441 | A1 | 10/2006 | Hill | |
| 2007/0103337 | A1 | 5/2007 | Heam et al. | |
| 2012/0319861 | A1 * | 12/2012 | Savage, Jr. | G08B 5/38 340/815.45 |
| 2015/0043231 | A1 * | 2/2015 | Clark | G09F 21/048 362/485 |

FOREIGN PATENT DOCUMENTS

| | | |
|---|---|---|
| JP | 2001338777 | 12/2001 |
| KR | 2003-0075226 | 9/2003 |
| KR | 1020030075226 | 9/2003 |
| KR | 2003-0089966 | 11/2003 |
| KR | 20030089966 | 11/2003 |
| KR | 2004-0110782 | 12/2004 |
| KR | 20040110782 | 12/2004 |

OTHER PUBLICATIONS

Crosswalk Angel, "Personal Defender", www.stopexperts.com, circa 2006.

Introducing the lightest and brightest defense system for your Crossing Guards who use signs. The Crosswalk Defender archive. org copy of www.stopexperts.com circa Feb. 8, 2005.

Manual on Uniform Traffic Control Devices (MUTCD) 1948 Edition, Part III, Signals, Section 278, U.S. Department of Transportation, Federal Highway Administration (FHWA).

Manual on Uniform Traffic Control Devices (MUTCD) 1961 Edition, Part III, Signals, Section 3G1-3G-7, U.S. Department of Transportation, Federal Highway Administration (FHWA).

Manual on Uniform Traffic Control Devices (MUTCD) 2003 Edition, Chapter 4D, U.S. Department of Transportation, Federal Highway Administration (FHWA).

Manual on Uniform Traffic Control Devices (MUTCD) 2003 Edition, Chapter 4K, U.S. Department of Transportation, Federal Highway Administration (FHWA).

Seat Belt Check Angel 8, www.stopexperts.com, circa 2006.

Stop Experts, Inc. "Crosswalk Defender", www.stopexperts.com, circa 2006.

Whelen Engineering Co., Inc., "Installation Guide 2 Channel/6 Channel Outlet LED Flasher" (IG), Copyright 2003.

Whelen Engineering Co., Inc., "Installation Guide 500 Series TIR6 Super LED Lighthead", 2002.

Whelen Engineering Co., Inc., Talon Series Specification (TSS) New Product Preliminary Bulletin, 2003, pp. 1-2.

Whelen Engineering Co., Inc., "Installation Guide 500 Series TIR6 Super LED Lighthead" 2002.

Manual on Uniform Traffice Control Devices (MUTCD) 1948 Edition, Part III, Signals, Section 278, U.S. Department of Transportation, Federal Highway Administration (FHWA).

Manual on Uniform Traffice Control Devices (MUTCD) 1961Edition, Part III; Signals, Section 3G1-3G-7, U.S. Department of Transportation, Federal Highway Administration (FHWA).

Manual on Uniform Traffice Control Devices (MUTCD) 2003 Edition, Chapter 4D, U.S. Department of Transportation, Federal Highway Administration (FHWA).

Manual on Uniform Traffice Control Devices (MUTCD) 2003 Edition, Chaptger 4K, U.S. Department of Transportation, Federal Highway Administration (FHWA).

* cited by examiner

TRAFFIC BEACON

CROSS-REFERENCE TO RELATED APPLICATIONS

This Application is a continuation of, and claims priority to U.S. application Ser. No. 14/480,912, filed Sep. 9, 2014, which claims priority to, and is a Continuation-in-Part of U.S. application Ser. No. 13/584,038 filed Aug. 13, 2013, now U.S. Pat. No. 9,129,540 issued Sep. 8, 2015, which is a continuation of U.S. application Ser. No. 13/230,242, filed Sep. 12, 2011, now U.S. Pat. No. 8,269,654, issued Sep. 18, 2012, which is a continuation of application Ser. No. 12/303,802 filed Dec. 8, 2008, now U.S. Patent No. 8,081,087 issued Dec. 20, 2011, and which is a National Stage Entry of PCT/US2007/070494, which claims the benefit of U.S. Provisional Application 60/811,157 filed Jun. 6, 2006, and now expired, the disclosures of all of which are incorporated by reference herein in their entireties. Application Ser. No. 14/480,912, filed Sep. 9, 2014 also claims priority to, and is a continuation of U.S. Provisional Application No. 61/879,431 filed Sep. 18, 2013, now expired and a continuation-in-part of U.S. Provisional Application No. 61/875,221 filed Sep. 9, 2013, now expired, the disclosures of all of which are incorporated by reference herein in their entireties.

BACKGROUND OF THE INVENTION

1. Field of the Invention

Disclosed herein is a flashing beacon. More specifically, disclosed herein is a flashing beacon that may be positioned on most any roadway sign or signpost, and that may include a signal unit, a control unit, a solar collector, an activation device (e.g., a timer, microwave emitter, radio transmitter, step-pad, a pushbutton, infrared transmitter, wireless transmitter or like device) and various other accessories.

2. Reference to Related Art

According to the U.S. Manual on Uniform Traffic Control Devices, flasher mechanisms associated with traffic control signs (e.g., a yield or crosswalk sign) must be positioned on the sign (or signpost) so that flashing signal is about 12 feet above the pavement. The flashing signal must also be programmed or otherwise set to flash continuously at a rate of not less than 50 nor more than 60 times per minute. See MUTCD, Section 4D.11. However, while the guidelines set forth in the uniform regulations are intended to provide a visible warning to drivers, recent testing has suggested that only a small percentage of the public responds to flashing signals that operate according to the uniform regulations. Specifically, recent testing has suggest that only about 10% of the public complies with or otherwise responds to flashing signals associated with roadway signage. Therefore, it would be advantageous to have an improved flashing beacon system that may be used with existing or future roadway signage to garner a greater response from the vehicle driving public.

SUMMARY OF THE INVENTION

About 20 years ago, the public began to demand that the automotive industry manufacture "quiet" cars and trucks—and the industry responded. Indeed, the industry responded so well that the interior of many vehicles have been effectively transformed into moving soundproof rooms. Unfortunately, the "quiet" has sometime resulted in drivers and passengers alike becoming distracted and forgetting that they are in a moving vehicle. For example, it is not uncommon for present day drivers to be seen talking on a cellular phone, reading a paper, listening to satellite stereo systems, being distract by children in the vehicle, applying makeup, using on-board navigation systems, watching a DVD, or just plain not paying attention to the roadway.

Clearly, one thing that is lost or diminished by all these possible distraction is a proper attention to and respect for roadway signage--signage that exists to increase motorist safety. Existing roadway signage is quite often clear and concise in meaning and message. These signs, however, lose their effectiveness when paired up against a distracted driver.

A 12" flashing beacon has been the tool of choice for the nation's roadways to emphasize a warning on a roadway sign since 1955. Indeed, the flashing pattern and height of these flash beacons might still work on some signs in certain locations. However, given the array of distractions now available to drivers, these traditional flashing beacons are simply too passive. Accordingly, disclosed herein is a beacon having a unique flashing sequence, and installation placement, that upon activation may command a driver's attention. As such, drivers are compelled to again look at a sign, understand its message, and respond.

As disclosed herein, a flashing beacon may include a signal unit, a control unit associated with the signal unit, a solar panel or collector, and an activation device that may all be mounted or otherwise positioned on a post of a roadway signpost. The activation device and solar panel may, however, also be positioned remotely from the post.

The signal unit may be rectangular in shape (although other shapes may be used) in order to decrease its obstructive profile relative to the sign, and it includes one or more flashable lights (e.g., LEDs) on the front, rear, bottom or side faces of the signal unit. One or more spotlights (e.g., LED spotlights) may also be positioned on the signal unit to illuminate an area (e.g., the street) in the vicinity of the signal unit. The signal unit may also include an audio transmission system and one or more displays (e.g., a LCD, plasma, or LEDs) to provide the user with information concerning the operation of the flashing beacon.

The control unit may include an electronic signal receiver (e.g., a radio receiver), a power supply, and control means for use in controlling the initiation and duration of the light assemblies of the flashing beacon.

The solar collector may include one or more solar cells that provide power to the unit during daylight hours and may also operate to recharge the power supply of the control unit so that the flashing beacon has adequate power during evening hours.

Finally, the activation device may include a pushbutton unit, signage, one or more counter displays, an infrared sensor, and a speaker system. Additional accessories for the activation device may also include devices such as a timer, microwave emitter, radio transmitter, step-pad, a pushbutton, infrared transmitter, wireless transmitter or like device. The signage associated with the pushbutton may also include a display (e.g., a LCD, plasma, or LEDs) to convey additional instructions to a pedestrian concerning operation of the flashing beacon and a counter to record the number of times the beacon has been activated. Finally, it will be appreciated that while the flashing beacon disclosed herein is discussed as being used in connection with a pedestrian crosswalk sign, it may also be used with any sign, placard or signal that uses a flashing signal (e.g., fire station sign, yield signs, dangerous curve signs, school speed zone signs, etc.).

BRIEF DESCRIPTION OF THE DRAWINGS

Reference will now be had to the attached drawings wherein like reference numerals refer to like parts throughout and wherein.

DESCRIPTION OF THE INVENTION

Figure 1:
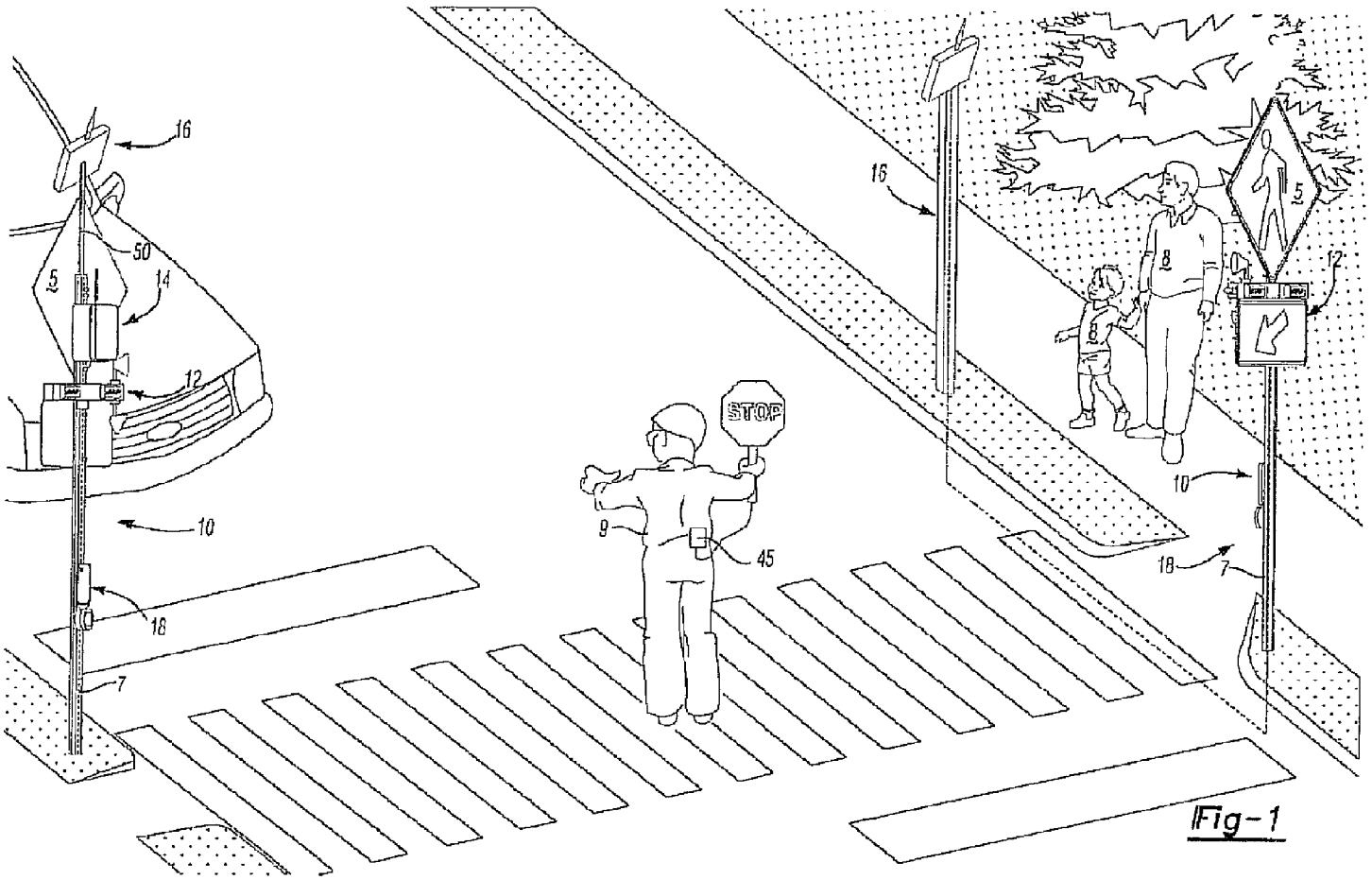
FIG. 1 is a environmental perspective View of a pair of flashing beacons constructed positioned on sign posts that are secured on opposite sides of a roadway, with one beacon having a remotely located solar cell and showing a crossing guard holding a stop sign with means to remotely activate the flashing beacons.

Referring now to FIGS. 1-10, a flashing beacon 10 for a sign(s) 5 may include a signal unit 12, a control unit 14, a solar collector 16, and an activation device 18 that may all be removably mounted to a post 7 of a sign 5. In operation, the flashing beacon 10 may provide a safer environment for drivers and pedestrians, particularly pedestrians attempting to traverse a busy street.

Figure 8:
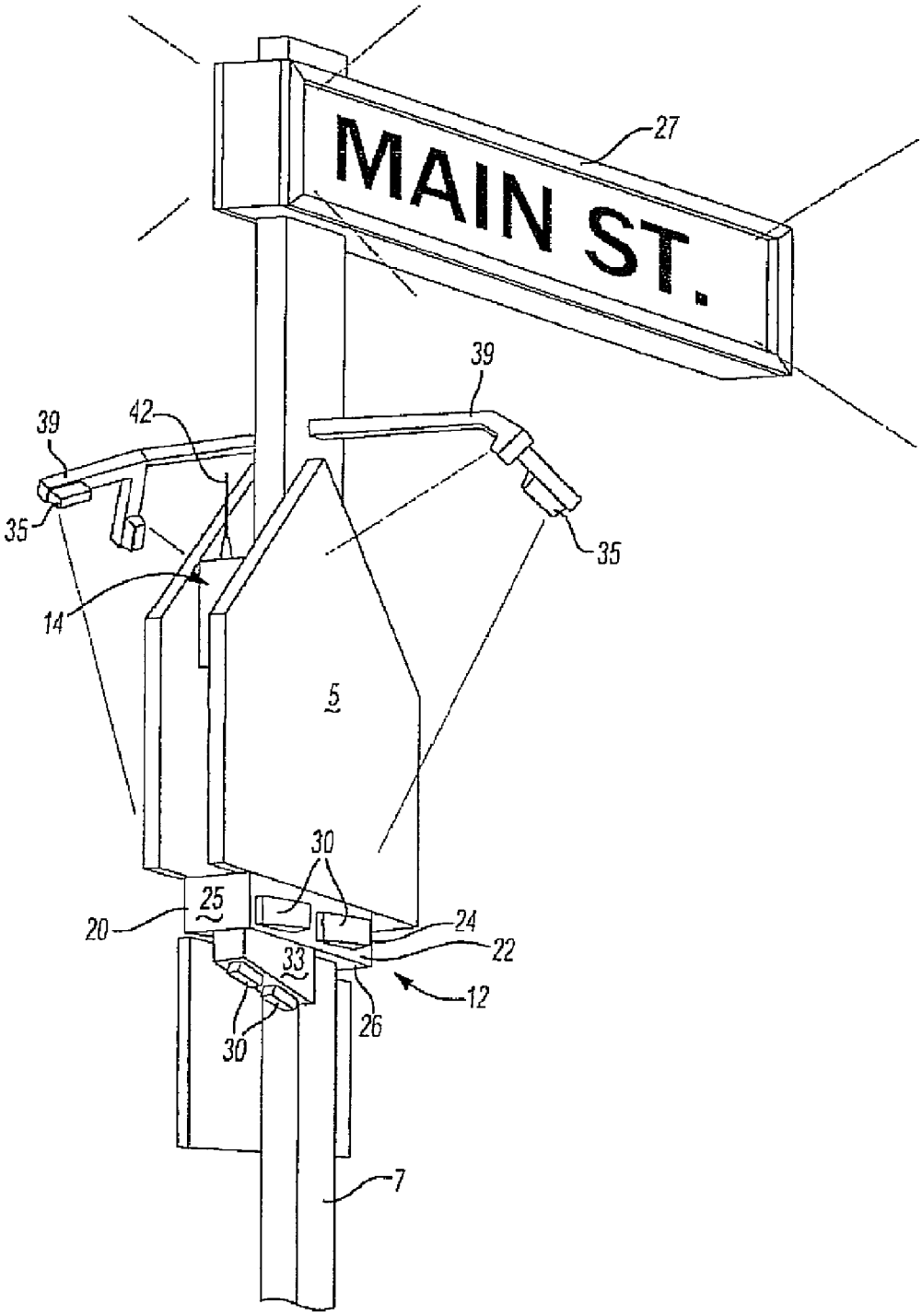
FIG. 8 is a side and rear perspective view of an embodiment of the flashing beacon showing, in particular, an illuminating street sign, sign illuminating spotlights, pivotable lights, and lights for illuminating the pavement proximate the flashing beacon.
Figure 9:
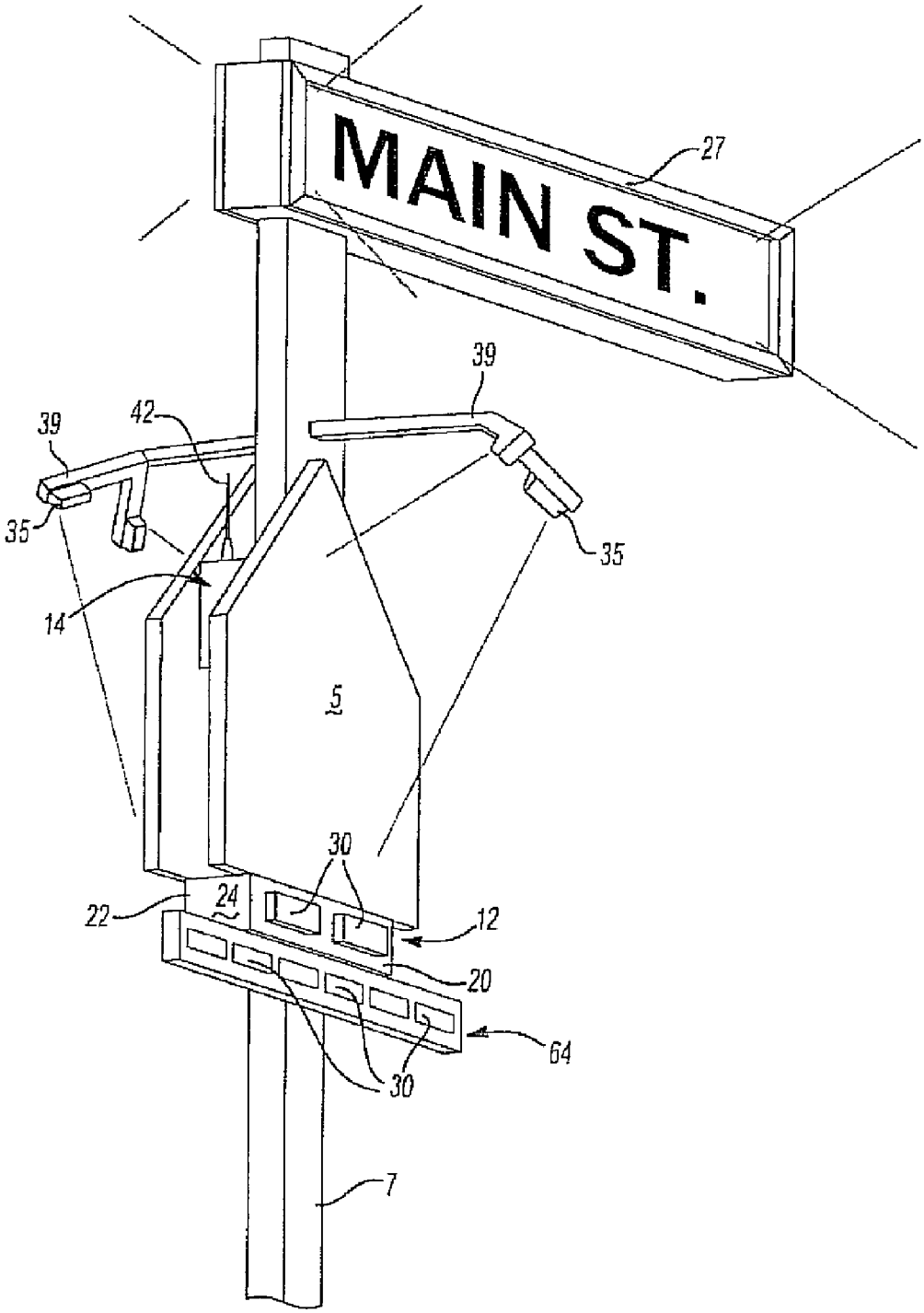
FIG. 9 is a side and front perspective view of an embodiment of the flashing beacon showing, in particular, an illuminating street sign, sign illuminating spotlights, pivotable lights, lights for illuminating the pavement proximate the flashing beacon and a light bar.
Figure 10:
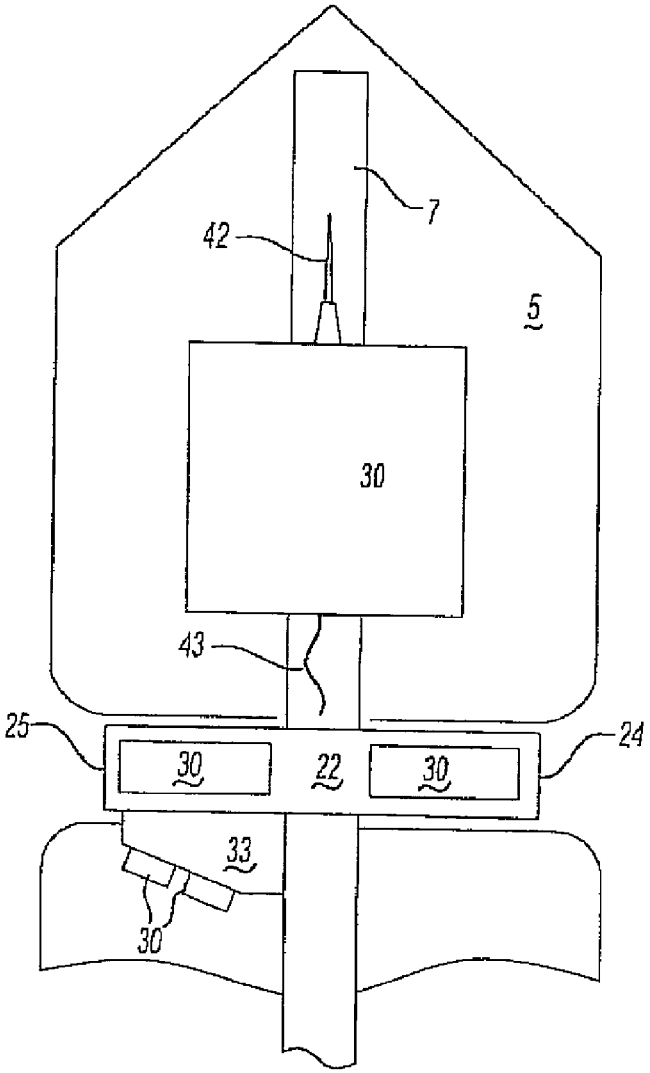
FIG. 10 is a rear view of an embodiment of the flash beacon showing, in particular, the radio signal receiving antennae.

Referring now to FIGS. 1-5, 8 and 9, the signal unit 12 may have an elongated, rectangular shaped body that may include a front face 20, a rear face 22, a pair of side faces 24, 25 and bottom face 26. A recess 28 may be defined in the front face 28 of the signal unit 12 such that the signal unit 12 may be positioned along the post 7 of the roadway sign 5. One or more light units 30 may be positioned on, or alternatively recessed within (see e.g., FIG. 8), each of the front face 20, the rear face 22, the side faces 24, 25 and the bottom face 26 of the signal unit 12. As shown in FIGS. 8 and 9, one or more illuminated street signs 27 may also be associated with each flashing beacon 10 and mounted by mounting each sign on the post of the sign 5. Further, as shown in FIG. 1, the signal unit 12 may be positioned on the sign post 7 immediately below the sign 5 so that, in a typically configuration, the light units 30 of the signal unit 12 are approximately the same distance above ground level as a traditional police cruiser. It is appreciated that a lighting array at such a height may receive greater recognition from a vehicle operator who might otherwise be "trained" to slow his or her vehicle when encountering flashing lights at tins height.

Figure 11:
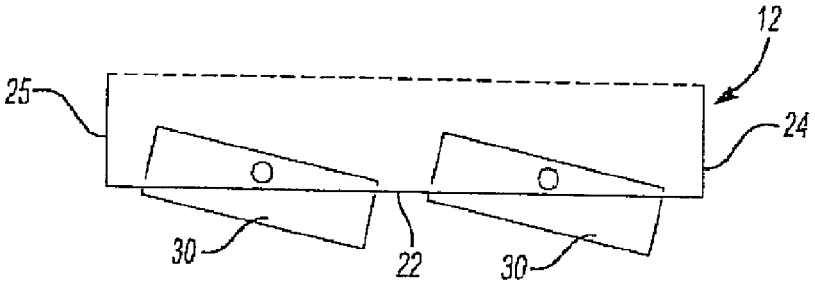
FIG. 11 is a top planar view of a signal unit of the flashing beacon showing the pivotable lights on the signal unit.

Referring to FIGS. 1-5, 8-11, and as best shown in FIG. 1, during operation of the flashing beacon 10 the light units 30 of tile front face 20 of the signal unit 12 may be illuminated to alert oncoming vehicle traffic that a pedestrian(s) 8 has or is about to enter a crosswalk. Light units 30 on the rear face 22 may also be illuminated concurrently with the light units 30 of the front face 20 to alert vehicle traffic traveling in the opposing direction. Accordingly, it will be appreciated that where at least one flashing beacon 10 is positioned on each side of a roadway (or, e.g., on at least one side and in a center median), a vehicle will be alerted to the presence of a pedestrian(s) in an approaching crosswalk regardless of the vehicle's direction of travel. Further, as shown in FIGS. 8 and 11, the light units 30 on the rear face 22 of the signal unit 12 may be pivotably mounted to the signal unit 12 so that (during setup) each light unit 30 may be precisely aimed at oncoming traffic.

Still referring to FIGS. 1-5, 8 and 9, in addition to the light units 30 associated with the front 20 and rear 22 face of the signal unit 12, the light units 30 of each side face 24, 25 of the signal unit 12 may be illuminated to alert the pedestrian(s) 8 and/or crossing guard(s) 9 using the flashing beacon 10 that the light units 30 on the front 20 and rear 22 face of the signal unit 12 been activated. As such, by observing the illumination of a light unit 30 on a side face 24, 25 of a signal unit 12, a pedestrian 8 or crossing guard 9 on one side of a roadway may easily confirm that the light units 30 on front 20 and rear 22 faces on a signal unit 12 on the opposite side of the roadway have also been activated.

Still referring to FIGS. 1-5, 8 and 9, in addition to the light units 30 on the front 20, rear 22, and side 24, 25 faces of a signal unit 12, each signal unit 12 may also include lighting for illuminating the area proximate base of the post 7, including at least a portion of a nearby roadway. For example, one or more light units 30 may be positioned on the bottom face 26 of the signal unit 12. Further, as shown in FIGS. 1-5, the signal unit 12 may also one or more spotlights 32 (e.g., LED spotlights) that extend from the signal unit 12. As shown in FIGS. 8 and 9, the spotlights 32 may be constructed as lighting pods 33 that are mounted to the bottom face 26 of the signal unit 12. Each lighting pod 33 may include one or more LED lights. The lighting pods 33 may also be mounted to a signal unit 12 so that any light emitting from the pod 33 is projected directly downward or at a predetermined angle relative to the post 7. Further, as shown in FIGS. 8 and 9, one or more spotlights 35 may be used to illuminate the face of a sign 5. Specifically, the spotlights 35 may be positioned on stanchions 39 that extend from the post 7.

Referring again to FIGS. 1-5, 8 and 9, as mentioned above the light units 30, spotlights 32 and other light units of the flashing beacon 10 may each include one or more light emitting diodes ("LEDs"). For example, LEDs of the type manufactured by Whelan Engineering Inc. may be used in connection with the light units 30 and spotlights 32 of flashing beacon 10. However, it will be appreciated that other types of lights may also be used with the flashing beacon 10.

The one or more of the lights of the light units 30 (i.e., the light units 30 on the bottom face 26) may function to be continuously illuminated during operation of the flashing beacon 10. However, as mentioned above, the light units 30 of the flashing beacon 10 may also function to flash according to uniform regulations at a rate of 50-60 cycles per minute, at an increased rate of 60-110 cycles per minute, or at any other rate predetermined by the user. The light units 30 may further be arranged such that they flash in a predetermined pattern such as a wavy line or a so-called wig-wag flashing pattern as will be described below.

Figure 5:
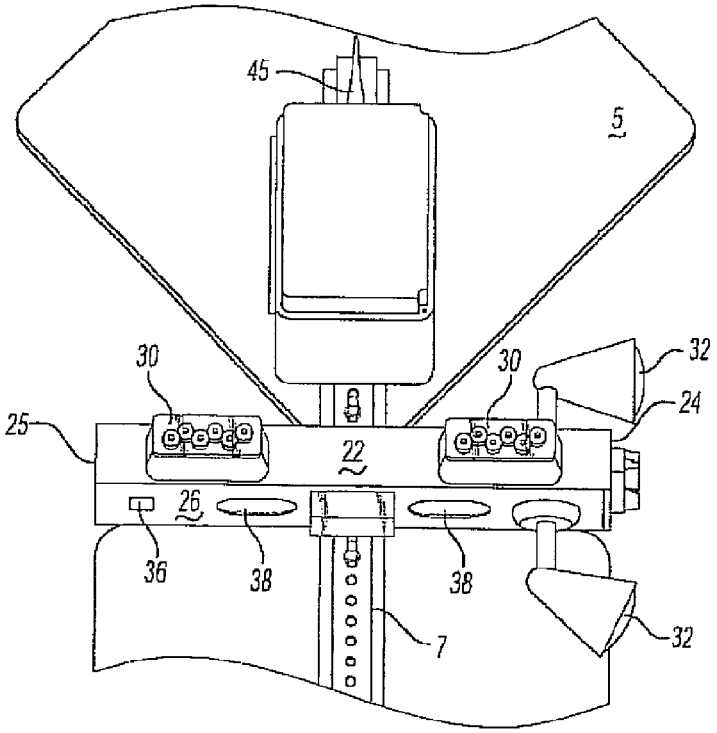
FIG. 5 is a rear perspective view of an embodiment of a flashing beacon constructed in accordance with the present invention that includes a view of the bottom face or underside of the signal unit of the flashing beacon.
Figure 6:
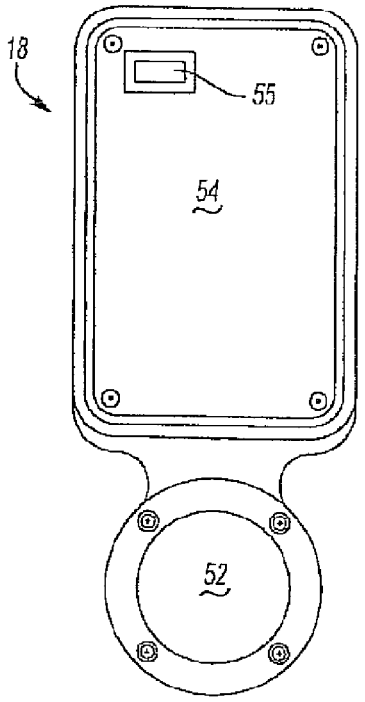
FIG. 6 is a front planar view of an embodiment of a pushbutton apparatus that may be used in connection with the flashing beacon.

Referring now to FIG. 5, the signal unit 12 may also include a programmable audio unit and a voltage meter display 36. The voltage meter display 36 (which may also be positioned in the control unit 14) may include an LCD, plasma screen monitor or an arrangement of LEDs positioned on the bottom face 26 of the signal unit 12 that may be in electrical communication with a power supply (i.e., a battery--not shown) of the control unit 14 (as discussed below) or another battery (not shown) that may be positioned in the signal unit 12. An audio unit (which may also be incorporated into the activation device 18) may include audio transmission apparatus that includes at least one speaker 38 and a memory means (e.g., an erasable/programmable memory). The memory means (not shown) may permit an administrator of the flashing beacon 10 to program and/or change an audio message that is broadcast to a user of the beacon 10.

Referring again to FIGS. 1-5, 8 and 9, the control unit 14 of the flashing beacon 10 may include one or more electronic signal receivers (i.e., a radio or wireless receiver) including an antenna 42, 43, a power supply (i.e., a battery), and control means (i.e., an erasable programmable memory (not shown) for use in controlling activation of the light units 30 and spotlights 32 of the signal unit 12.

In operation, the control unit 14 may be used to selectively activate and deactivate the various lights of the flashing beacon 10. For example, a school principal, crossing guard 9 (see FIG. 1), or public safety official may use a remote transmitter to activate, program or otherwise control the activation of the flashing beacon 10 by transmitting an appropriate signal to the signal receiver of the control unit 14. More specifically, as shown in FIG. 1, the crossing guard 9 may carry with him or her a personal flash beacon system 45 such as the Personal Defender™ or Crosswalk Defender™ manufactured by Stop Experts, Inc. of Venice, Fla. These personal flash beacon systems may include a radio transmitter that when activated results in the activation of the lights of the flashing beacon 10 and when deactivated results in the deactivation of the lights of the flashing beacon.

Referring now to FIGS. 1-4, the solar collector 16 may include a panel of one or more solar cells 48. The panel 16 may be positioned on arm 50 that extends above the sign from the control unit 16, or that is otherwise mounted to the post 7 of the sign 5. Further, as shown in FIG. 1, in those instances where the overhead tree cover may prevent sufficient exposure of the solar collector to direct sunlight, the solar collector 16 may be positioned a predetermined distance away from the flashing beacon 10 and electrically connected to the beacon 10 by means of underground electrical wire and conduit. It will be appreciated that the solar collector 16 may be used as a clean power source for the signal unit 12 and the control 14 of the flashing beacon 10 during daylight hours. It may also be appreciated that the solar collector 16 may communicate with the power supply of the control unit 14 to thereby provide power to the flashing beacon 14 during evening hours.

Referring now to FIGS. 1-4, 6 and 7, the activation device 18 may include a pushbutton 52 in electrical, wireless or radio communication with the control unit and/or the signal unit, and one or more placards 54 that may convey additional information concerning operation of the flashing beacon 10. Pushing the pushbutton 52 may activate that flashing beacon 10. However, it should also be appreciated that other devices such as a timer, microwave emitter, radio transmitter, step-pad, internal activation means, a timer, a pushbutton, infrared transmitter, wireless transmitter or like device. For example, the activation device may include an infrared sensor 57 that may detect the presence of an individual within a predetermined range (e.g., 5 feet) from the device 18 and respond by activation of the flashing beacon 10.

Figure 7:
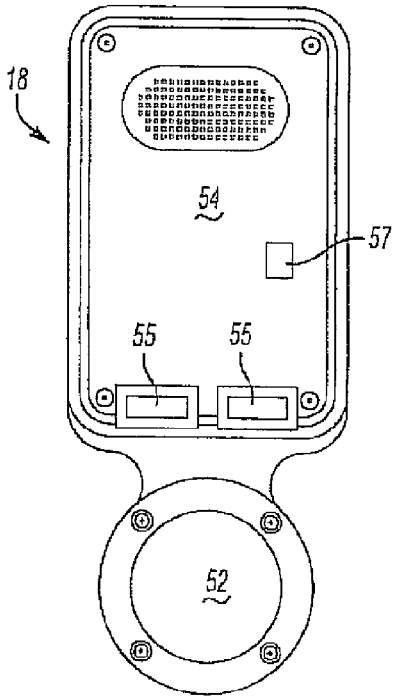
FIG. 7 is a front planar view of another embodiment of a pushbutton apparatus that may be used in connection with the flashing beacon.

Still referring to FIGS. 1-4, 6 and 7, one or more displays 55 (e.g., LCD, plasma screen monitor, or LEDs) may also be positioned on the activation device 18 to provide a user with an additional instructional message. For example, as shown in FIG. 7, the activation device may include a pair of displays 55 that indicate the number of time the flashing beacon has been activated during daylight hours (right side) and after dark (left side). Likewise, as mentioned above, the activation device 18 may include memory means and an associated speaker system capable for providing a user with an audible instructional message.

Figure 2:
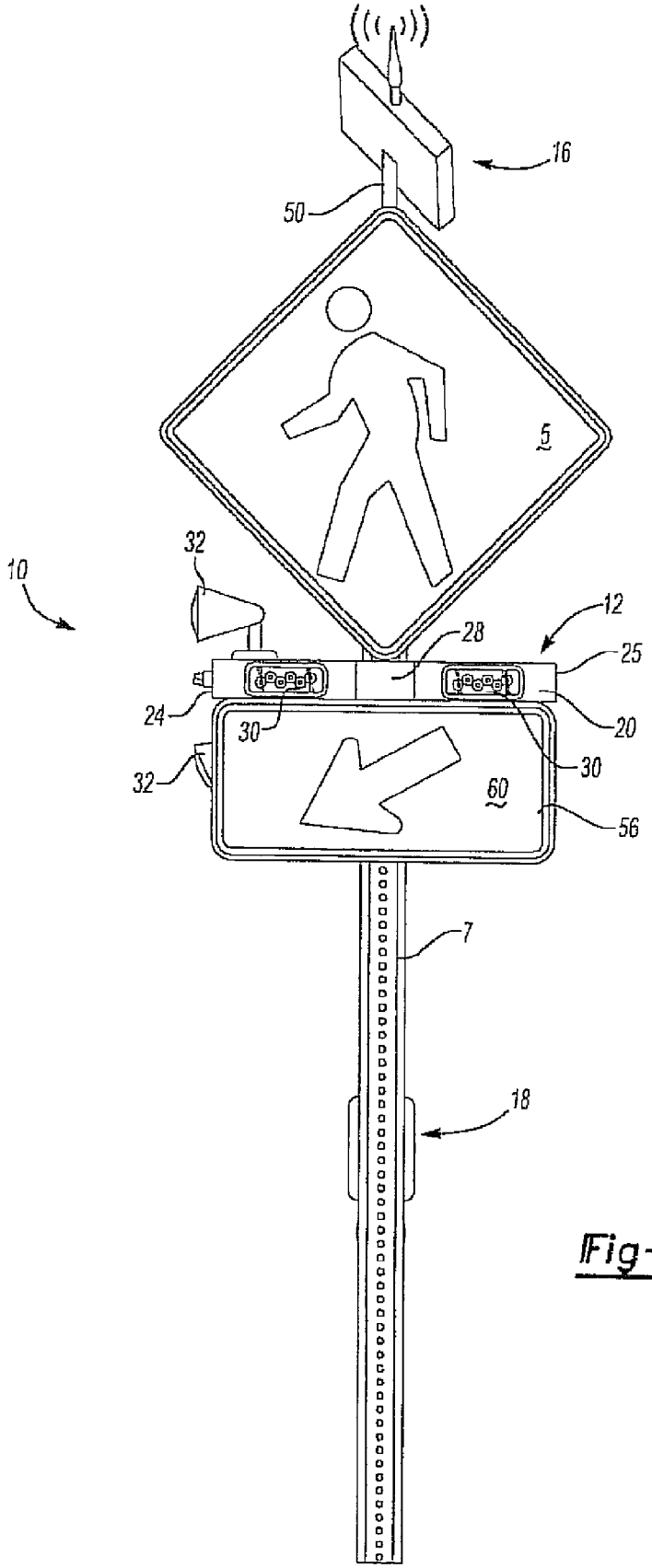
FIG. 2 is a front planar view of an embodiment of a flashing beacon wherein the double-sign unit is in a first or retracted position.
Figure 3:
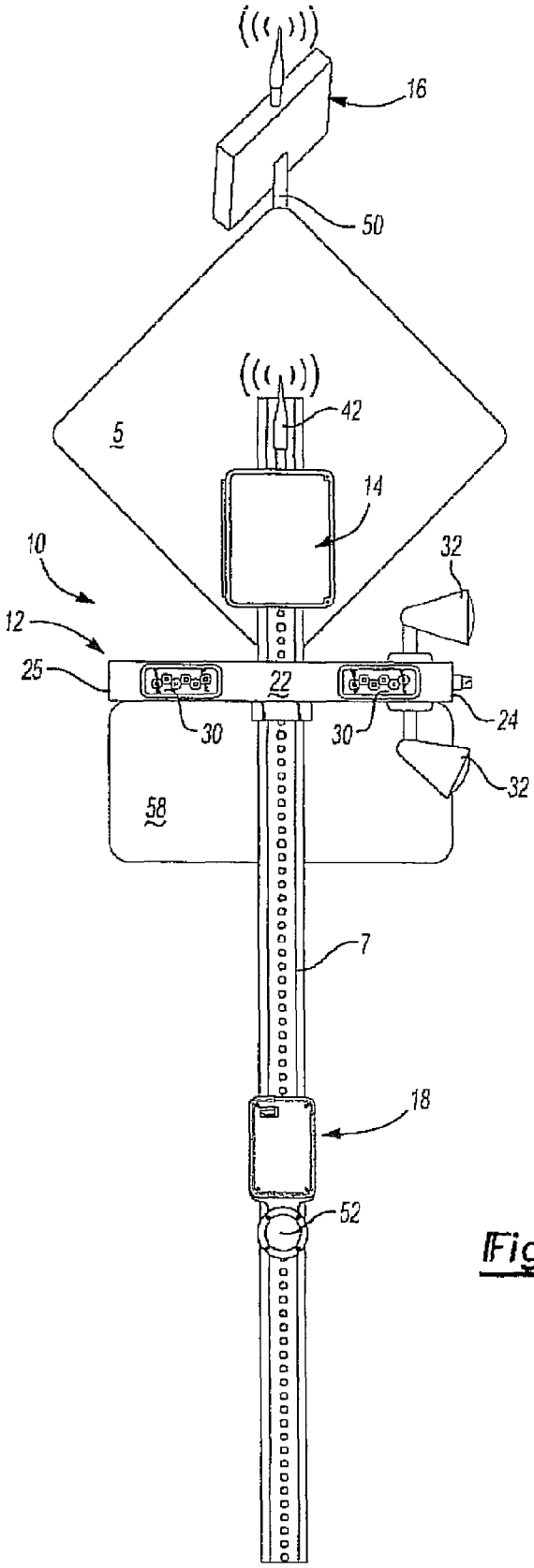
FIG. 3 is a rear planar view of an embodiment of a flashing beacon.
Figure 4:
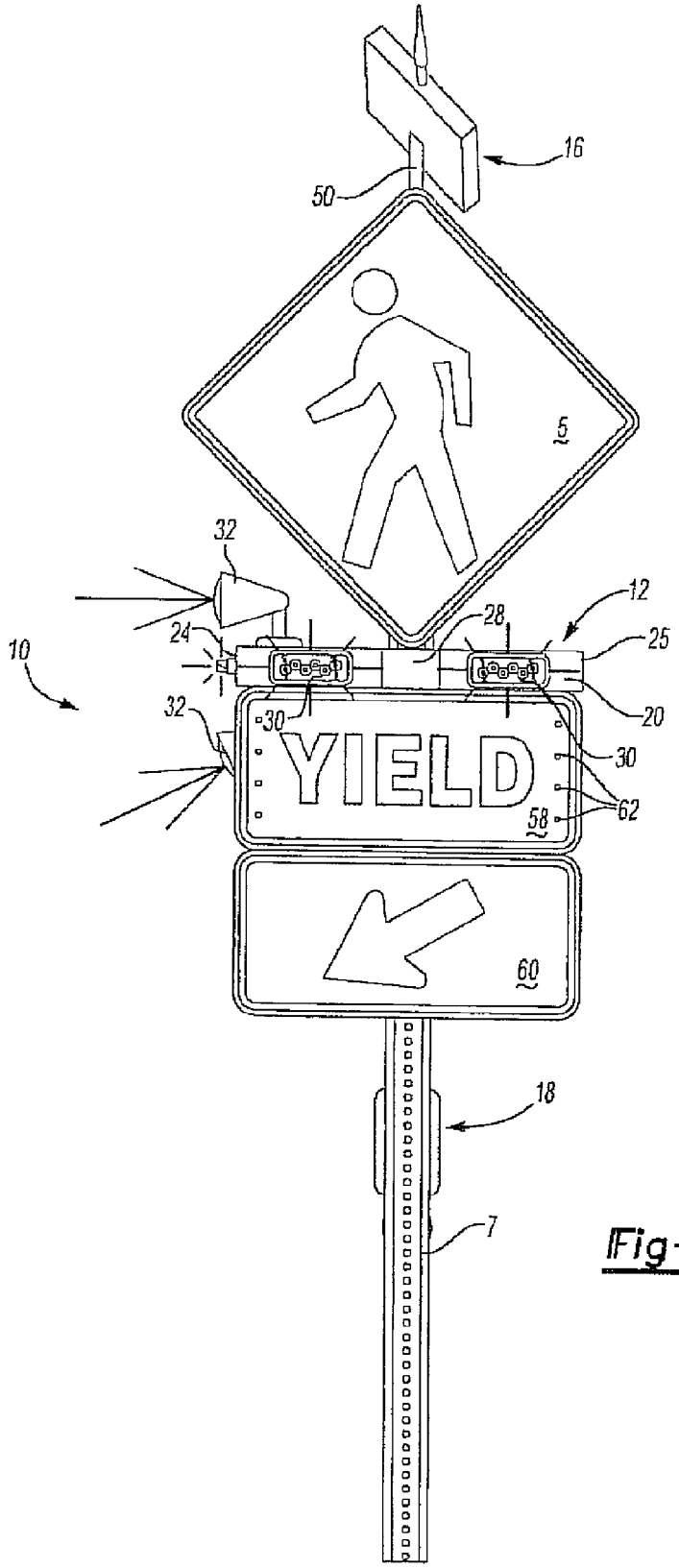
FIG. 4 is a front planar view of an embodiment of a flashing beacon wherein the double-sign unit is in a second or extended position.

Referring now to FIGS. 1-3, the flashing beacon 10 may also include a double-sign unit 56. As shown in FIG. 2, the double-sign unit 56 may include a first sign placard 58 and a second sign placard 60 that is movable relative to the first sign placard 58. Prior to activation of the flashing beacon 10, the second sign placard 60 may be positioned in front of the first sign placard 58. However, upon activation of the flashing beacon 10, the second sign placard 60 may be translated or otherwise shifted to a second position to thereby reveal the first sign placard 58. Further, the first sign placard may include one or more LEDs 62 to thereby illuminate the first sign placard.

Referring now to FIG. 9, a light bar 64 that may include one or more light units 30 may be positioned on the signpost 7 below the signal unit 12. Alternatively, the light bar 64 may be positioned above the signal unit 12 or between the light unit 30 on the front face 20 of the signal unit 12. In operation, the light bar 64 functions to quickly "flash" any oncoming vehicles. Typically, tins flash may about 112 to 2 seconds after any lights on the front 20, rear 22, or side 24, 25 faces of the signal unit 12 had been activated. The advantage of this "flash" (in addition to the normal illumination of tile flashing beacon) is that a vehicle that is already within a predetermined distance from the flashing beacon 10 may not see the flash because, in many instances, the vehicle will have already driven past the beacon 10 given the 2 second delay period. However, vehicles that were beyond the predetermined distance when the flashing beacon 12 was activated will encounter not only the normal illumination of the flashing beacon, but also the secondary "flash" of the light bar 64. As such, the secondary flash functions as a further reminder to the driver to heed the commands of the associated sign 5.

In preliminary testing of the flashing beacon disclosed herein, Applicant has achieved significant improvement over the traditional flash beacon systems known in the art.

EXAMPLE 1

A study of percent of vehicle responses to 70 pedestrian crossings comparing a traditional (MUTCD Standard) flashing beacon with dual side mounted lights (top row) against Applicant's flashing beacon with dual flashing overhead lights with a "wig-wag" flashing pattern (bottom row) in the City of St. Petersburg, Fla. at 3151 Street north of 54th Avenue South. A wig-wag pattern is described as follows: Where the front face 20 of the signal unit 12 of the flashing beacon 10 being tested included two side-by-side LED lights, each wig-wag cycle including two flashes (adjustable) of one light and, simultaneously, three flashes (adjustable) of the other light. The speed of the left and right flashes is adjusted so that the cycle time for the three flashes for the other light is equal to the cycle time for the two flashes. Each flash beacon tested was set up to function at a rate of 76 wig-wag cycles per 30 seconds (for a total of 190 total flashes).

EXAMPLE 2

A study of percent of vehicle response to 70 pedestrian crossings comparing traditional (MUTCD Standard) flashing beacon with dual side mounted lights (top row) against Applicant's flashing beacon, using a wig-wag pattern, placed in a four-lane divided highway with median (bottom row) in the City of St. Petersburg, Fla. at 4th Street and 18th Avenue South.

OTHER EXAMPLES

Pattern Combinations Between Two (or More) Lights

Wig-wag patterns of 2-3, 2-4 and 2-5 have been tested and considered immensely successful by both federal government, a variety of state governments, and a number of universities. More than a 10× improvement in driver compliance has been found. Wig-wag patterns can be broken down into several categories including, but not limited to: symmetric, asymmetric, synchronous, alternating, pseudo-random, asynchronous, and intermixed. In all categories it is possible that some flash patterns will command a greater human behavioral response, e.g., get more drivers to comply with traffic laws and warnings, than other patterns.

A symmetric wig-wag pattern is a pattern where there left and right lights (or up and down lights) flash in an identical fashion. Flash patterns can be synchronous or alternating as will be explained below.

An asymmetric (or irregular) wig-wag pattern is a pattern where there is a human perceptible difference between the flash pattern of a first light and a second light. The asymmetry can in any manner, for example, in the number of flashes per cycle, in periodicity, in the perceptible brightness of flashes, in the color of the lights, in the flash duty cycle, or so on.

A synchronous wig-wag pattern is a pattern where the periodicity of a first light and a second light are the same (or nearly so), and the timing between lights does not change perceptibly to a casual observer over a few cycles.

An alternating wig-wag pattern is a pattern where (for a given cycle) one light starts flashing a first sequence, and after the end of its flashing sequence the other light flashes its sequence.

A delayed-alternating wig-wag pattern is a pattern where (for a given cycle) one light starts flashing a first sequence, and after the beginning but before the end of its flashing sequence the other light flashes its sequence.

A pseudo-random wig-wag pattern is a pattern where one or both lights use a sequence that appears to change one cycle to the next for two or more cycles. Such cycles can be synchronous, asymmetric, alternating, delayed-alternating, or other. For example, a pseudo-random, alternating sequence can appear as a 2-3 (alternating) followed by a 2-5 (alternating) followed by a 4-2 (alternating) pattern, or perhaps a 2-3 (alternating) followed by a 2-5 (alternating) followed by a 4-2(simultaneous) pattern.

An asynchronous signal is one where first and second lights operate independently, or apparently so based on human perception. An example of which would be a left right flashing intermittently four flashes at a time every second (with a 50% duty cycle) followed by an off period of one second, while the right light flashes once every 1.33 seconds with an on-period of 0.25 seconds.

A function-dependant pattern is a pattern where one or more lights responds in some manner (e.g., flash intensity, flash duration, period between flashes, etc., or a combination thereof) according to one of more predictable functions (repeating or non-repeating), such as a sine wave, a square wave, a step function of N steps (where N>3), a triangular wave, a saw-tooth, an exponential function, a logarithmic function, and so on. For example, assuming a saw-tooth function, a light may strobe at a constant brightness and duration (e.g., 25 mS) over two second cycles where the time between the first and second flashes is 200 mS and the time between flashes decreases linearly such that the time between the last two flashes is 25 mS, then the pattern repeats.

An intermixed signal is any workable combination of the above sequences. As the total number of variations to this theme is nearly inexhaustible, no attempt will be made to list them.

OTHER EXAMPLES

Strobing

The only accepted pattern for crosswalk signs over 40 years has been a single light flashing at less than 60 cycles per second with a duty cycle of 50% or thereabout. However, strobed lights appear to be much more effective than non-strobed lights. A strobed light is herein defined as a light having a duty cycle of 25% (on) or less for a given on-off cycle; or an on time of 200 mS or less (type 1 strobe), 100 ms or less (type 2 strobe), or 50 mS or less (type 3 strobe).

OTHER EXAMPLES

Single Lights

It is possible that, with the right flash pattern and/or light characteristic, a single light (as opposed to a paired/multiple light system) may be effective in commanding improved human behavioral response and therefore increased driver compliance. Example systems would have, for example, a strobed single light of N-number of first strobes over 0.5 seconds followed by a dark period of 0.5 seconds, N-number of first strobes over 0.5 seconds followed by a constant on-period of 1 second, N-number of first strobes over 0.5 seconds followed by M-number of second strobes over 0.5 second, N-number of first strobes over 0.5 seconds followed by M-number of second strobes over 0.5 second followed by P-number of third strobes over 0.7 seconds, and so on. There is an irregularity (or asymmetry) one cycle to the next, and as the total number of variations to this theme is nearly inexhaustible, no attempt shall be made to list them all.

Symmetry from one cycle to the next cycle may be present in other embodiments as long as the duty cycle is not 50% and/or flashing at a rate less than or equal to sixty cycles per second. Strobing can be used to increase human behavioral response.

OTHER EXAMPLES

N by M Continuous Arrays

It is possible to form a 2-D graphic sign that can form letters, dynamically-changing patterns or both. Generally, N should equal 1 or more and M should equal 3 or more. For example, assuming a light array that appears to a driver as a continuous array and has a 1-light by 10-light structure, a back-and-forth (or up and down) pattern of lights may be generated using one, two, three or more lines at a time. Different color lights, e.g., yellow and white, may be intermixed. By way of another example, a 15 by 200 array may produce more sophisticated patterns of seemingly continuously-structured and continuously changing patterns.

OTHER EXAMPLES

Light Shape

Bar-shaped/rectangular lights (as illustrated) have shown great promise, but other light shapes may be useful. For example, round lights, crescent-shaped lights, triangular-shaped lights, and so on, can produce different human behavioral responses.

OTHER EXAMPLES

Methodology

Testing of strobe patterns can be performed to determine whether an individual pattern produces a desired result, i.e., a human behavior response that causes an increased driver compliance. Such testing is described as selecting a particular pattern for one or more lights--the pattern having some irregularity/asymmetry of any form (including any of the types described above) and/or use of strobing. The pattern is then tested in a real-world environment to see whether the pattern is effective in producing improved driver compliance for crosswalks. The pattern can then be incorporated for use in a crosswalk system if the pattern shows acceptable driver compliance, e.g., compliance over 70%, 80%, 90%, or at least better than a previously used standard.

Having thus described my invention, various other embodiments will become known to those of skill in the art that do not depart from the spirit of the present invention.

The invention claimed is:

1. A flashing beacon system for alerting oncoming traffic comprising:

a first light unit and a second light unit, the first and second light units facing in a first direction;

a controller for said first and second light units;

the controller configured to activate the first light unit to flash on and off according to a flashing cycle, the flashing cycle having at least first and second "on" intervals when the first light unit is illuminated and at least first and second "off" intervals when the first light unit is not illuminated, a second "off" interval being of greater duration than a first "off" interval;

the controller configured to activate the second light unit to flash on and off according to a flashing cycle, the flashing cycle having at least first and second "on" intervals when the second light unit is illuminated and at least first and second "off" intervals when the second light unit is not illuminated, a second "off" interval being of greater duration than a first "off" interval; and at least one of the following (a) and (b):

(a) at least one additional light unit facing a direction other than said first direction, said additional light unit being illuminated when at least one of said first and second light units are flashing, (b) a rechargeable power source to provide power at least to said first and second light units.

2. The flashing beacon system according to claim 1 wherein said first and second light units flash simultaneously.

3. The flashing beacon system according to claim 1 wherein said first and second light units flash sequentially.

4. The flashing beacon system according to claim 1 wherein said first light unit and the second light unit each flash the same number of times during their respective flashing cycles.

5. The flashing beacon system according to claim 1 wherein said first light unit flashes a different number of times than said second light unit during their respective flashing cycles.

6. The flashing beacon system according to claim 1 wherein at least one of said first and second light units includes two identical flashing cycles.

7. The flashing beacon system according to claim 1 wherein at least one of the first and second light units includes two consecutive identical flashing cycles.

8. The flashing beacon system according to claim 1 wherein at least one of said first and second light units includes at least two non-identical flashing cycles.

9. The flashing beacon system according to claim 1 wherein at least one of said first light unit includes at least two non-identical consecutive flashing cycles.

10. The flashing beacon system according to claim 1 wherein the total duration of the "on" time of the first light unit during a flashing cycle and the total duration of the "on" time of the second light unit during a flashing cycle are the same.

11. The flashing beacon system according to claim 1 wherein the total duration of the "on" time of the first light unit during a flashing cycle and the total duration of the "on" time of the second light unit during a flashing cycle are different.

12. The flashing beacon system according to claim 1 wherein the number of "on" flashes of at least one of the first and second light units is adjustable.

13. The flashing beacon system according to claim 1 and further including at least one traffic directive signal facing in said first direction.

14. The flashing beacon system according to claim 1 and further including at least one of the following:

(c) a push button to activate the flashing of said light units;

(d) a transmitter for remotely activating the flashing of said light units;

(a) a timer for deactivating the flashing of said first and second light units;

(f) a third light unit and a fourth light unit, the controller for activating the third and fourth light units to flash according to flashing cycles when said first and second light units are activated to flash.

15. The flashing beacon system according to claim 1, including (a) and (b).

16. The flashing beacon system according to claim 1, including (b) and further including a solar collector for recharging said rechargeable power source.

17. The flashing beacon system according to claim 1 including (a) and further including a timer for deactivating the flashing of said first and second light units and for deactivating said additional light unit.

18. The flashing beacon system according to claim 1, and further including a third light unit and a fourth light unit, the controller for activating the third and fourth light units to flash according to flashing cycles when sad first and second light units are activated to flash.

19. The flashing beacon system according to claim 18, and further including (a).

20. The flashing beacon system according to claim 18, and further including (a)

wherein said direction other than said first direction is at an angle to but not opposite to said first direction.

21. The flashing beacon system according to claim 20, wherein at least one of said third light unit and said fourth light unit are facing in said first direction.

22. The flashing beacon system according to claim 20, wherein both of said third light unit and said fourth light unit are facing in said first direction.

23. The flashing beacon system according to claim 20, wherein at least one of said third light unit and said fourth light unit are facing in a second direction opposite to said first direction.

24. The flashing beacon system according to claim 20, wherein both of said third light unit and said fourth light unit are facing in a second direction opposite to said first direction.

* * * * *